US008596619B2

(12) United States Patent
Volin

(10) Patent No.: US 8,596,619 B2
(45) Date of Patent: Dec. 3, 2013

(54) ADJUSTABLE GATE HAVING OPPOSITE ANTI-WARPING SYSTEMS, OPPOSITE PERSONAL-INJURY-ELIMINATING SYSTEMS, OPPOSITE SCREW-CENTERING SYSTEMS, OPPOSITE S-HOOK-INTERLOCKING SYSTEMS, AND OPPOSITE TURNBUCKLE-INTERLOCKING SYSTEMS

(71) Applicant: Dee Volin, Fairview, OR (US)

(72) Inventor: Dee Volin, Fairview, OR (US)

( * ) Notice: Subject to any disclaimer, the term of this patent is extended or adjusted under 35 U.S.C. 154(b) by 0 days.

(21) Appl. No.: 13/736,045

(22) Filed: Jan. 7, 2013

(65) Prior Publication Data

US 2013/0175489 A1 Jul. 11, 2013

Related U.S. Application Data

(60) Provisional application No. 61/631,781, filed on Jan. 10, 2012.

(51) Int. Cl.
*E04H 17/16* (2006.01)

(52) U.S. Cl.
USPC ..... 256/73

(58) Field of Classification Search
USPC ..... 256/43, 47, 65.01, 65.04–65.06, 65.08, 256/65.09; 403/43–46, 109.1, 109.2, 363, 403/383
See application file for complete search history.

(56) References Cited

U.S. PATENT DOCUMENTS

| | | | | | |
|---|---|---|---|---|---|
| 734,509 | A | * | 7/1903 | Caesar | 248/188.5 |
| 1,039,017 | A | * | 9/1912 | Bonness | 411/233 |
| 2,846,958 | A | * | 8/1958 | Cale | 410/111 |
| 4,062,523 | A | * | 12/1977 | Nowatzki et al. | 256/47 |
| 4,422,622 | A | * | 12/1983 | Broski, Jr. | 256/25 |
| 4,628,635 | A | | 12/1986 | Maillard | |
| 4,793,098 | A | | 12/1988 | Wilkerson | |
| 4,831,777 | A | | 5/1989 | Johnson, Jr. | |
| 5,628,149 | A | | 5/1997 | Kraczek | |
| 5,716,041 | A | | 2/1998 | Groves | |
| 5,868,382 | A | * | 2/1999 | Groves | 256/73 |
| 5,906,068 | A | | 5/1999 | Bode | |
| 6,010,117 | A | | 1/2000 | Doxey | |
| 6,176,043 | B1 | | 1/2001 | Gibbs | |
| 6,398,193 | B1 | | 6/2002 | DeSouza | |
| 6,464,209 | B2 | | 10/2002 | Meis et al. | |
| 6,561,493 | B1 | | 5/2003 | Lackey, Jr. | |
| 6,588,732 | B1 | | 7/2003 | Caceres et al. | |
| 6,751,906 | B2 | | 6/2004 | Bass | |
| 6,896,244 | B2 | | 5/2005 | Boroviak | |
| 7,114,706 | B1 | | 10/2006 | Bemis et al. | |

(Continued)

*Primary Examiner* — Michael P Ferguson
*Assistant Examiner* — Daniel Wiley

(57) ABSTRACT

An adjustable gate comprises two u-shaped vertical bars having first anti-warping gutters, tension hooks; two horizontal bars having second anti-warping gutters; a chain-link mesh; two tension rods; and a truss having paddle-nuts. The first anti-warping gutters are inserted into the second anti-warping gutters to join the bars together and to prevent the gate from warping in all horizontal directions. The tension hooks are welded along the body of the vertical bars to eliminate tie wires to prevent personal injury. The tension rods are inserted along the vertical edges of the chain-link mesh and hooked on the tension hooks. The truss hooks on the vertical bars and is adjusted to a desired tension to hold the adjustable gate together. The truss paddle-nuts disposed at the two opposite ends of the truss turnbuckle interlock with the truss turnbuckle in a desired position and allow the truss tension to be increased or decreased incrementally.

9 Claims, 20 Drawing Sheets

(56) References Cited

U.S. PATENT DOCUMENTS

| | | | | |
|---|---|---|---|---|
| 7,429,032 | B2 | 9/2008 | Stull | |
| 7,448,599 | B2 | 11/2008 | Boroviak | |
| 7,500,655 | B1 | 3/2009 | Smith et al. | |
| 2008/0006808 | A1 * | 1/2008 | Thompson | 256/45 |

* cited by examiner

ADJUSTABLE GATE HAVING OPPOSITE ANTI-WARPING SYSTEMS, OPPOSITE PERSONAL-INJURY-ELIMINATING SYSTEMS, OPPOSITE SCREW-CENTERING SYSTEMS, OPPOSITE S-HOOK-INTERLOCKING SYSTEMS, AND OPPOSITE TURNBUCKLE-INTERLOCKING SYSTEMS

REFERENCE TO PREVIOUSLY FILED PROVISIONAL PATENT APPLICATION

Provisional Patent Application No. 61/631,781 was filed on Jan. 10, 2012.

FIELD OF THE INVENTION

The present invention relates to an adjustable gate, which easy, convenient, and safe to assemble, and strong, durable, and safe to use. Particularly, the present invention relates to an adjustable gate having opposite anti-warping systems, opposite personal-injury-eliminating systems, opposite screw-centering systems, opposite S-hook-interlocking systems, and opposite turnbuckle-interlocking systems.

DESCRIPTION OF THE PRIOR ART

A number of adjustable gates have been introduced.

U.S. Pat. No. 4,628,635, filed Jan. 23, 1985, to Susan Maillard; U.S. Pat. No. 4,793,098, filed Jun. 24, 1987, to Destre L. Wilkerson; U.S. Pat. No. 4,831,777, filed Feb. 22, 1988, to Stanley A. Johnson Jr.; U.S. Pat. No. 5,628,149, filed Mar. 28, 1996, to John Kraczek; U.S. Pat. No. 5,716,041, filed Feb. 13, 1997, to Michael F. Groves; U.S. Pat. No. 5,868,382, filed Sep. 19, 1997, to Michael F. Groves; U.S. Pat. No. 5,906,068, filed Dec. 23, 1996, to Gerd Bode; U.S. Pat. No. 6,010,117, filed Oct. 22, 1996, to Robert L. Doxey; U.S. Pat. No. 6,176,043, filed Jan. 14, 1999, to Edward L Gibbs; U.S. Pat. No. 6,398,193, filed Jun. 25, 1999, to Joseph Desouza; U.S. Pat. No. 6,464,209, filed Dec. 4, 2000, to William J. Meis; U.S. Pat. No. 6,561,493, filed Oct. 19, 2000, to Joe Lackey Jr.; U.S. Pat. No. 6,588,732, filed May 6, 1999, to Peter B. Caceres; U.S. Pat. No. 6,751,906, filed Jan. 3, 2002, to Donnie E. Bass; U.S. Pat. No. 6,896,244, filed Jun. 5, 2003, to Richard Boroviak; U.S. Pat. No. 7,114,706, filed Apr. 2, 2004, to Jeff Bemis; U.S. Pat. No. 7,429,032, filed Jan. 14, 2005, to Edward J. Stull; U.S. Pat. No. 7,448,599, filed Jul. 31, 2007, to Richard Boroviak; and U.S. Pat. No. 7,500,655, filed Aug. 18, 2004, to Frederick L. Smith disclose a variety of inventions related to adjustable gates.

The prior art has failed to solve many problems associated with such adjustable gates, as follows:

1) No prior art offers or discloses any gate having opposite anti-warping systems with opposite anti-warping gutters to prevent the gate from warping in all horizontal directions. Therefore, the prior-art gates warp in all horizontal directions.
2) No prior art offers or discloses any gate having opposite personal-injury-eliminating systems to eliminate personal injury. Therefore, the prior-art gates quite often cause personal injuries.
3) No prior art offers or discloses any gate having opposite screw-centering systems. Therefore, the prior-art gates requires many persons working together to assemble each prior-art gate.

4) No prior art offers or discloses any gate having opposite S-hook-interlocking systems. Therefore, the prior-art gates are weak, non-durable, and unreliable.
5) No prior art offers or discloses any gate having opposite turnbuckle-interlocking systems. Therefore, the prior-art gates sag quickly after being in use for a period of time.
6) No prior art offers or discloses any gate having tension hooks welded to the u-shaped vertical bars to eliminate the use of tie wires. Therefore, the assemblage of the prior-art gates is tedious, time-consuming, and hazardous.
7) No prior art offers or discloses any gate having S-hook-interlocking circular hooks welded to the u-shaped vertical bars to reinforce the S-hook openings. Therefore, the S-hook openings of the prior-art gates is weak and easily bent out of shape after being in use for a period of time.
8) No prior art offers or discloses any gate having interlocking paddles molded into paddle-nuts to incrementally interlock with the turnbuckle of a truss in a predetermined position. Therefore, the truss of the prior-art gates cannot incrementally and securely interlock the horizontal bars and the u-shaped vertical bars of the adjustable gates at a predetermined tension.

OBJECTS AND ADVANTAGES OF THE INVENTION

The present invention substantially departs from the conventional concepts and designs of the prior art. In doing so, the present invention provides a unique adjustable gate having many unique and significant features, automatic functions, and advantages, which overcome all the disadvantages of the prior art, as follows:

1) It is an object of the present invention to provide the unique adjustable gate having opposite anti-warping systems, which have the anti-warping u-shaped-bar gutters of u-shaped vertical bars inserted into the anti-warping horizontal-bar gutters of horizontal bars to prevent the u-shaped vertical bars and the horizontal bars from rotating, bending, and warping in all horizontal directions. As a result, the opposite anti-warping systems prevent the adjustable gate from bending and warping in all horizontal directions.
2) It is another object of the present invention to provide the unique adjustable gate having opposite anti-warping systems, which have the anti-warping u-shaped-bar gutters of u-shaped vertical bars inserted into the anti-warping horizontal-bar gutters of horizontal bars to prevent the u-shaped vertical bars and the horizontal bars from rotating, bending, and warping. As a result, the opposite anti-warping systems eliminate the needs for an extra person to hold the horizontal bars and the u-shaped vertical bars still when screwing the screws through the horizontal bars and the u-shaped vertical bars to assemble the adjustable gate.
3) It is a further object of the present invention to provide the unique adjustable gate having opposite personal-injury-eliminating systems, which have the tension hooks welded to the u-shaped vertical bars to eliminate using tie wires to connect the u-shaped vertical bars to a chain-link mesh, to prevent the tie wires from cut and scratching people. As a result, the opposite personal-injury-eliminating systems eliminate personal injury.
4) It is an even further object of the present invention to provide the unique adjustable gate having opposite personal-injury-eliminating systems, which have the tension hooks welded to the u-shaped vertical bars to eliminate the needs for using many tie wires and an extra person to tediously and hazardously twist the tie wires to connect the u-shaped vertical bars to a chain-link mesh when assembling the adjustable gate. As a result, the opposite personal-injury-eliminating systems make the assembling of the adjustable gate easy, save time, and reduce hazard.

5) It is another object of the present invention to provide the unique adjustable gate having opposite screw-centering systems, which have the self-centering-screw guiding slots stamped into the anti-warping gutters of the horizontal bars to accurately guide a screw through the horizontal bars and the u-shaped vertical bars, to prevent accident. As a result, the opposite screw-centering systems eliminate accident and provide accuracy for the gate-assembling process.

6) It is yet another object of the present invention to provide the unique adjustable gate having opposite screw-centering systems, which have the self-centering-screw guiding slots stamped into the anti-warping gutters of the horizontal bars to accurately guide a screw through the horizontal bars and the u-shaped vertical bars, to prevent accident. As a result, the opposite screw-centering systems eliminate the needs for measuring, and speed up the process of the adjustable-gate assemblage.

7) It is still yet another object of the present invention to provide the unique adjustable gate having opposite S-hook-interlocking systems, which have the S-hook-interlocking circular hooks welded into the S-hook openings of the u-shaped vertical bars to reinforce the S-hook openings and to interlock the circular hooks and the S-hooks of a truss. As a result, the opposite S-hook-interlocking systems increase the strength the S-hook openings, durably interlock the S-hooks and the u-shaped vertical bars, and increase the durability and reliability of the gate-assemblage process.

8) It is still yet an even further object of the present invention to provide the unique adjustable gate having opposite turnbuckle-interlocking systems, which have the interlocking paddles molded into paddle-nuts to incrementally interlock with the turnbuckle of the truss in a predetermined position, to incrementally lock the truss wire at a predetermined tension. As a result, the opposite turnbuckle-interlocking systems incrementally and securely interlock the horizontal bars and the u-shaped vertical bars of the adjustable gate at a predetermined tension.

Other objects and advantages of the present invention will become apparent from a consideration of the accompanying drawings and ensuing description.

SUMMARY OF THE INVENTION

Figure 8A:
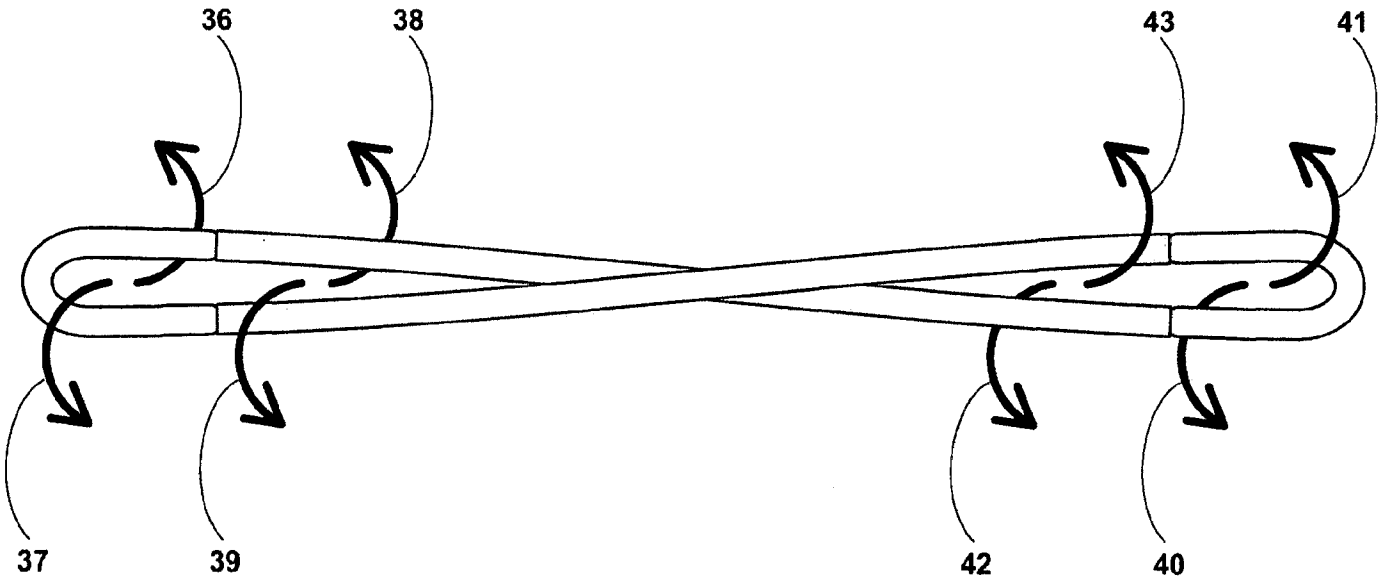
FIG. 8A illustrates a top view of a common tubular gate frame being warped after being in use for a period of time.
Figure 8B:
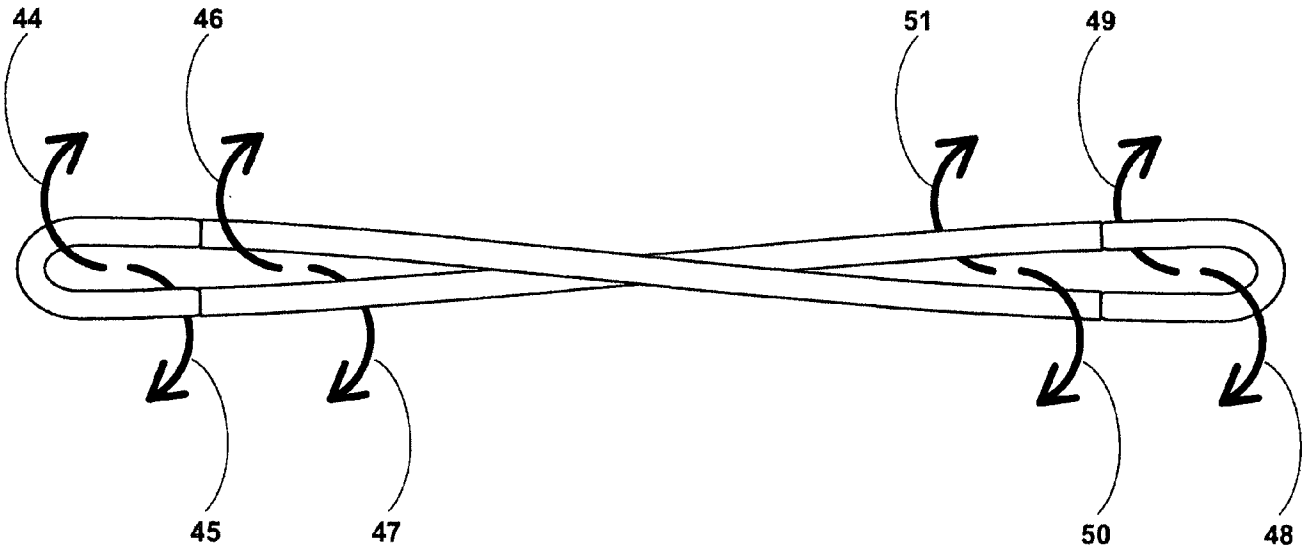
FIG. 8B illustrates a top view of a common tubular gate frame being warped, in different directions, after being in use for a period of time.

An adjustable gate comprises two opposite u-shaped vertical bars having first anti-warping gutters, tension hooks; two horizontal bars having second anti-warping gutters; a chain-link mesh; two opposite tension rods; tie wires; and a truss having paddle-nuts. The first anti-warping gutters are inserted into the second anti-warping gutters to join the bars together and to prevent the gate from warping in all horizontal directions (as illustrated in FIGS. 8A and 8B). The tension hooks are welded along the body of the vertical bars to eliminate tie wires to prevent personal injury. The tension rods are inserted along the opposite edges of the chain-link mesh and hooked on the tension hooks. The tie wires tie the mesh to the horizontal bars. The truss hooks on the vertical bars and is adjusted to a desired tension to hold the adjustable gate together. The truss paddle-nuts disposed at the two opposite ends of the truss turnbuckle interlock with the truss turnbuckle in a desired position and allow the truss tension to be increased or decreased incrementally.

Preferred Embodiment

Structure

Referring to FIGS. 8A and 8B, prior-art gates warp in all horizontal directions after being used for a period of time. In contrast, the adjustable gate of the current invention will prevent this and many other disadvantages associated with prior-art gates.

Figure 1:
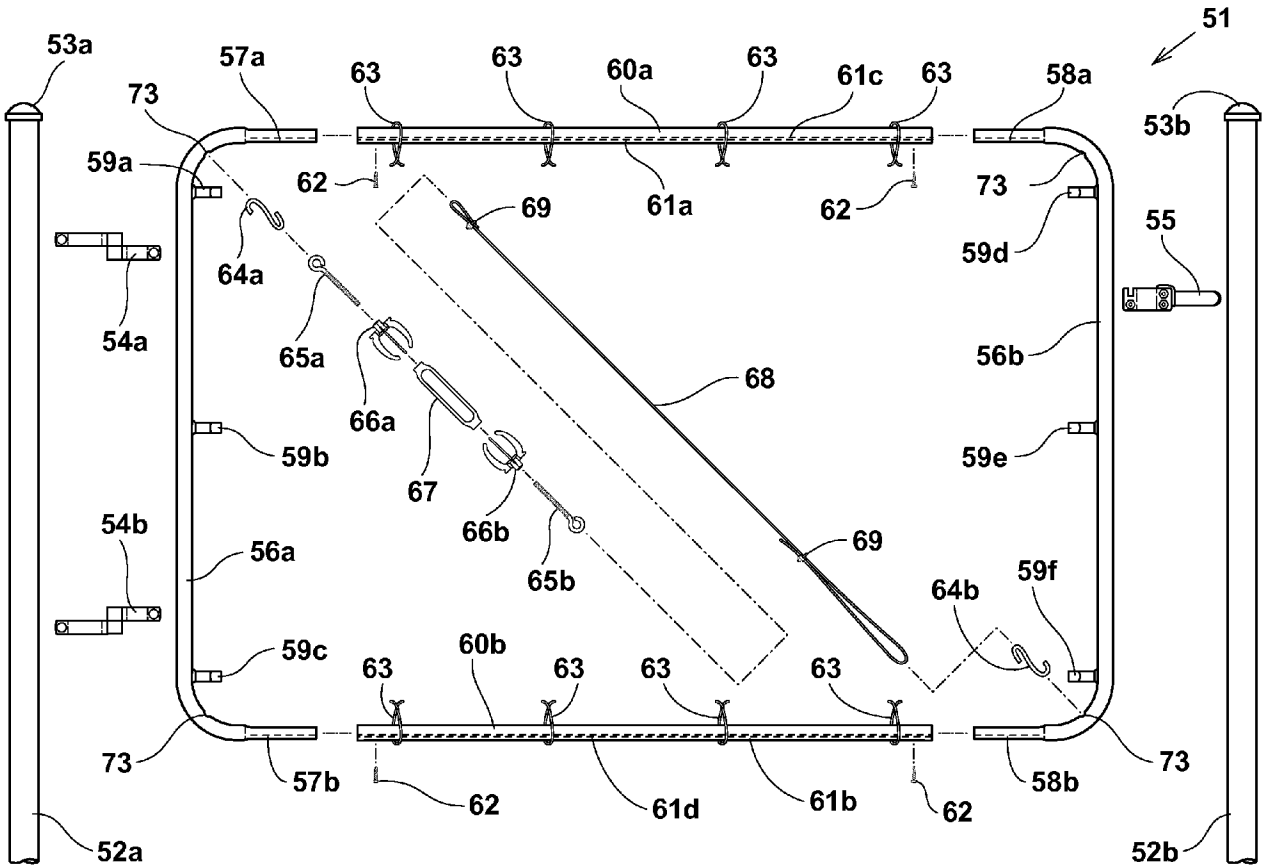
FIG. 1 illustrates an exploded view of an adjustable gate having frame-anti-twisting, frame-stabilizing, truss-hook-interlocking, and personal-injury-eliminating systems.
Figure 2A:
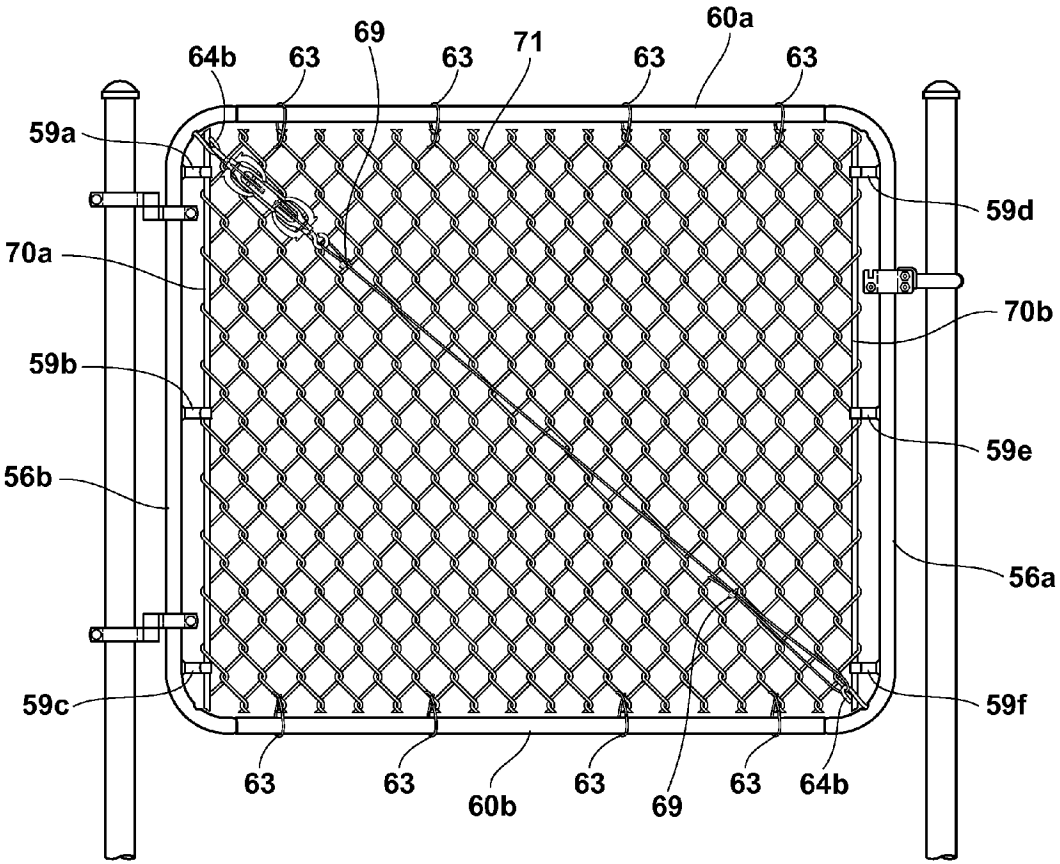
FIG. 2A illustrates a front view of the adjustable gate having frame-anti-twisting, frame-stabilizing, truss-hook-interlocking, and personal-injury-eliminating systems.
Figure 2B:
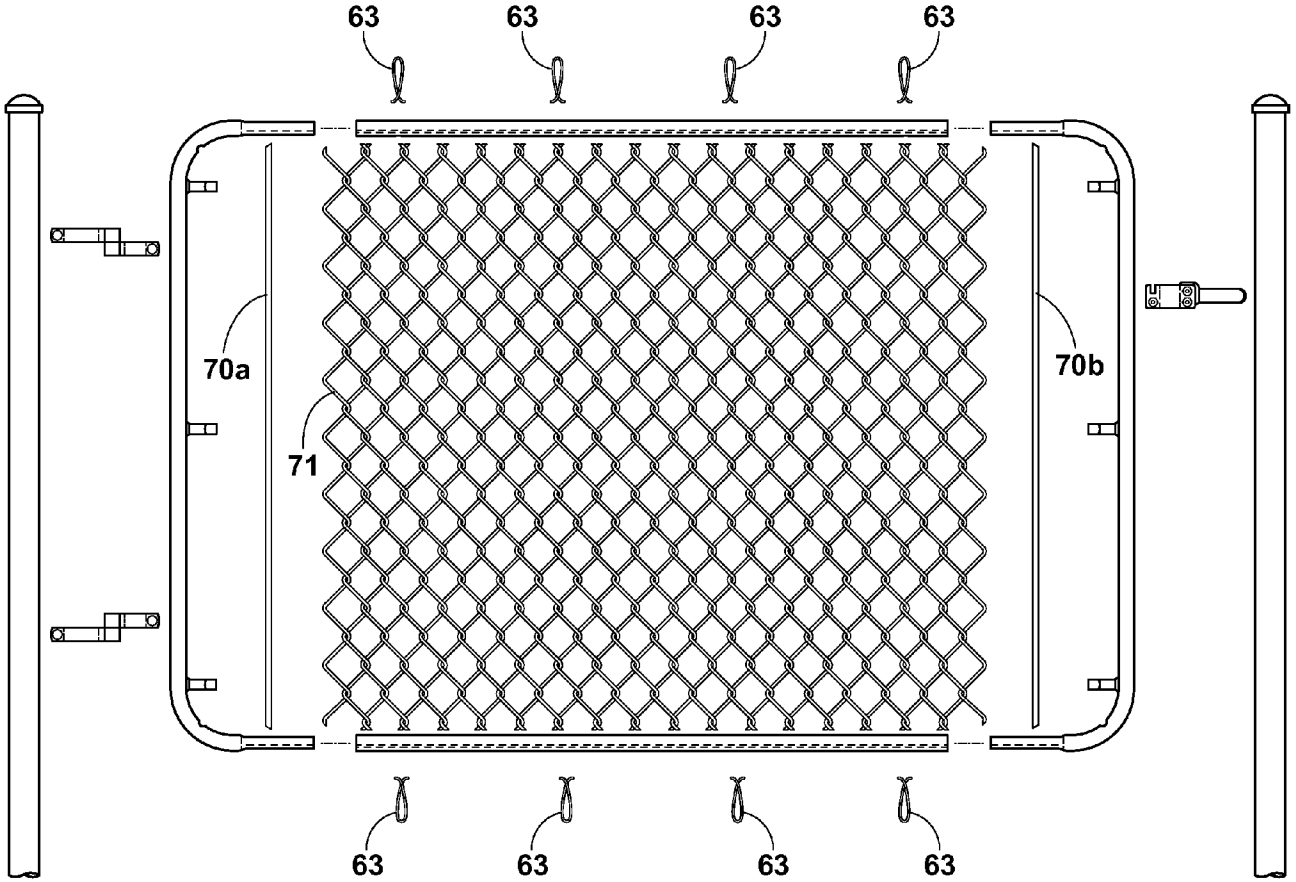
FIG. 2B illustrates an exploded view of chain-link-tensioning components of the adjustable gate.

FIGS. 1, 2A, and 2B illustrate the front and exploded views of the adjustable gate having opposite anti-warping systems, opposite personal-injury-eliminating systems, opposite screw-centering systems, opposite S-hook-interlocking systems, and opposite turnbuckle-interlocking systems. The adjustable gate comprises:

opposite adjustable-gate posts 52*a* and 52*b*, opposite post caps 53*a* and 53*b* mounted thereon, adjustable-gate hinges Ma and 54*b*, an adjustable-gate latch 55, two opposite anti-warping u-shaped vertical bars 56*a* and 56*b*, four anti-warping u-shaped-bar gutters 57*a*, 57*b*, 58*a*, and 58*b*, a plurality of opposite welded tension hooks 59*a*, 59*b*, 59*c*, 59*d*, 59*e*, and 59*f*, upper and lower anti-warping adjustable horizontal bars 60*a* and 60*b*, two anti-warping adjustable-horizontal-bar gutters 61*a* and 61*b*, upper and lower self-centering-screw guiding slots 61*c* and 61*d*, a plurality of self-tapping screws 62, a plurality of tie wires 63, two truss S-hooks 64*a* and 64*b*, two opposite truss eye-bolts 65*a* and 65*b*, two opposite self-locking paddle-nuts 66*a* and 66*b*, a turnbuckle 67, a truss wire 68, two opposite truss-wire clamps 69, two opposite chain-link-mesh tension rods 70*a* and 70*b*, and a chain-link mesh 71.

Opposite post caps 53*a* and 53*b* are attached to adjustable-gate posts 52*a* and 52*b*, respectively.

Gate hinges 54*a* and 54*b* are attached to one of adjustable-gate posts 52*a* and 52*b*, and are attached to one of opposite anti-warping u-shaped vertical bars 56*a* and 56*b*.

Adjustable-gate latch 55 is attached to one of adjustable-gate posts 52*a* and 52*b*, and is attached to one of opposite anti-warping u-shaped vertical bars 56*a* and 56*b*.

Figure 3A:
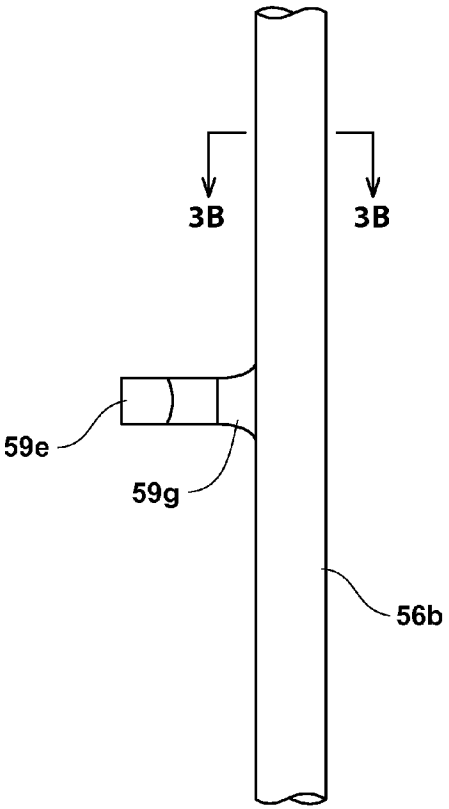
FIG. 3A illustrates a front view of the anti-warping u-shaped vertical bar having a personal-injury-eliminating system.
Figure 3B:
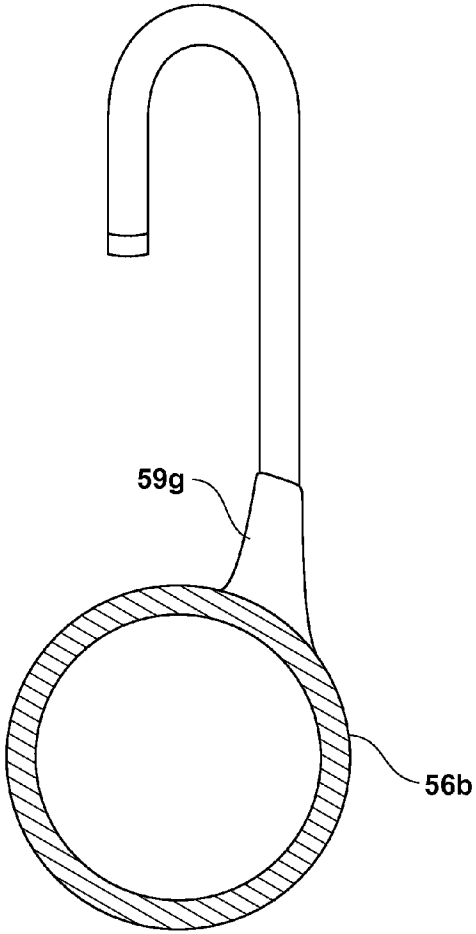
FIG. 3B illustrates a top view of a personal-injury-eliminating hook of the personal-injury-eliminating system.
Figure 4A:
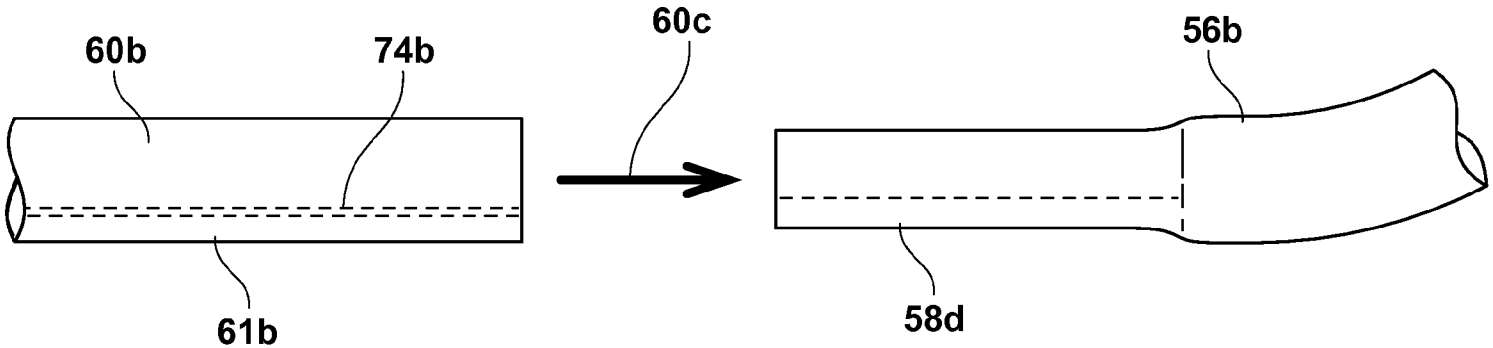
FIG. 4A illustrates a front view of an anti-warping adjustable horizontal bar and an anti-warping u-shaped vertical bar of the adjustable gate.
Figure 4B:
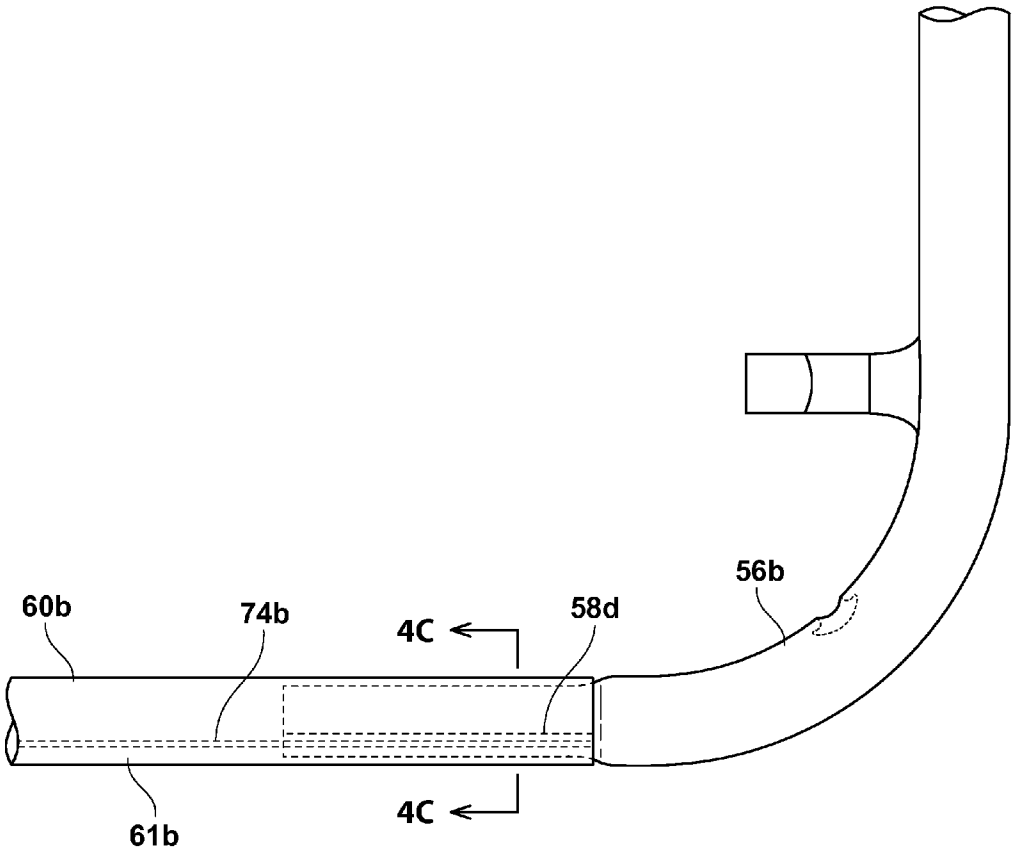
FIG. 4B illustrates a front view of the anti-warping adjustable horizontal bar and an anti-warping u-shaped vertical bar being assembled.
Figure 4C:
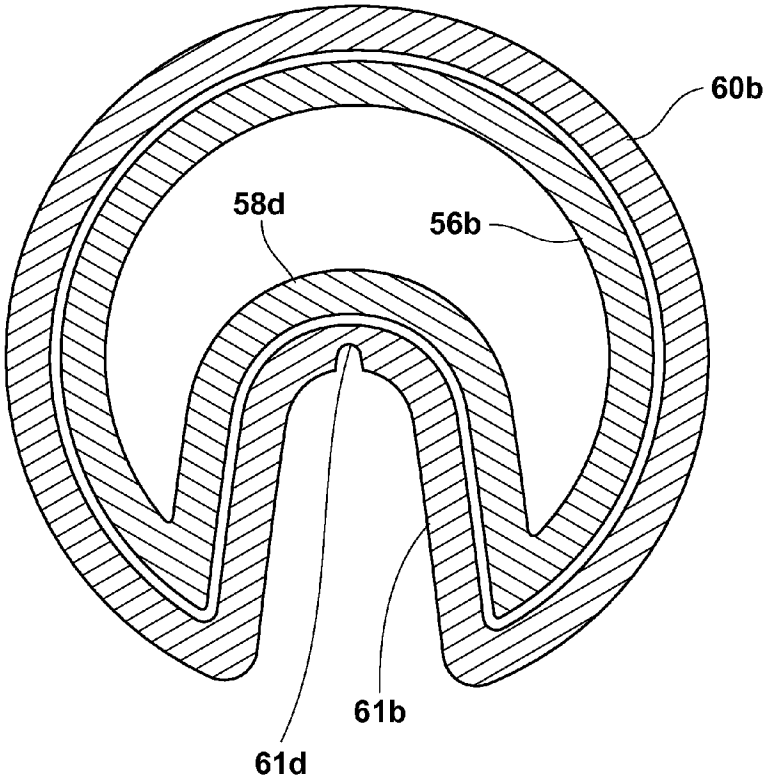
FIG. 4C illustrates a cross-sectional view of the anti-warping adjustable horizontal bar and an anti-warping u-shaped vertical bar being assembled.
Figure 4D:
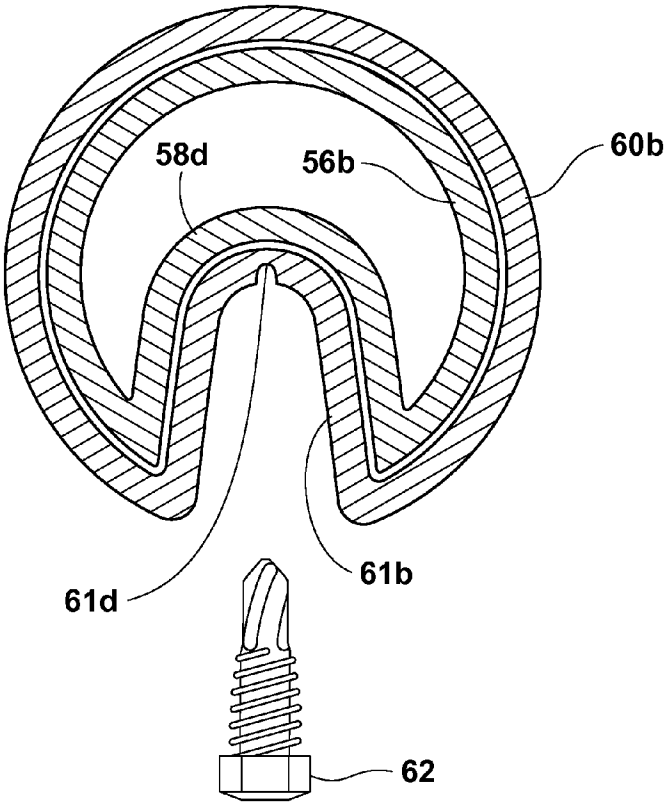
FIG. 4D illustrates a cross-sectional view of the anti-warping adjustable horizontal bar and an anti-warping u-shaped vertical bar being assembled, and the location where a self-tapping screw would be screwed therethrough.
Figure 4E:
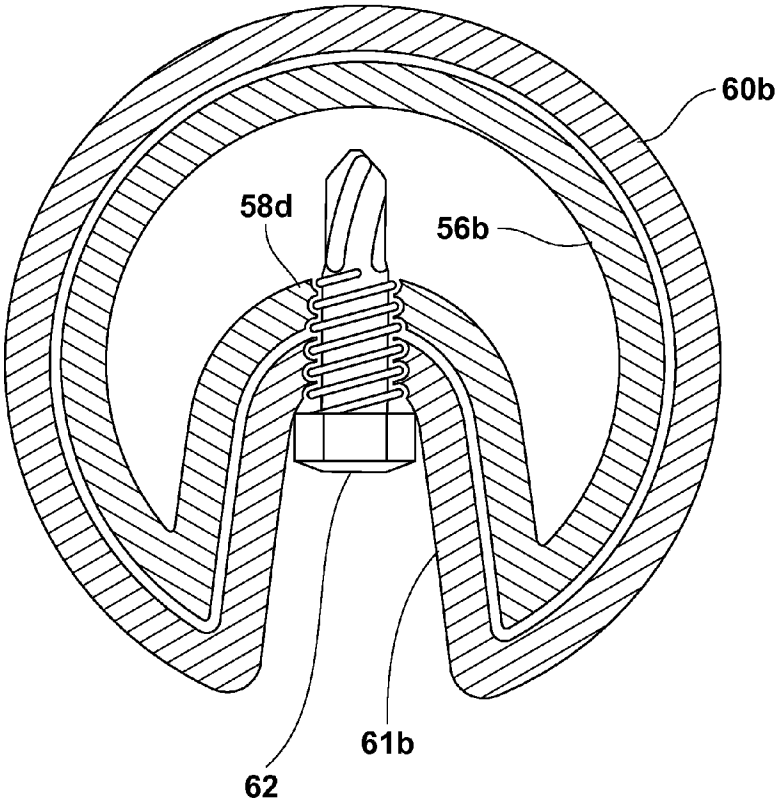
FIG. 4E illustrates a cross-sectional view of the anti-warping adjustable horizontal bar and an anti-warping u-shaped vertical bar being assembled, and the self-tapping screw after being screwed therethrough.

Referring to FIGS. 3A and 3B, opposite welded tension hooks 59*a*, 59*b*, 59*c*, 59*d*, 59*e*, and 59*f* are welded, by welding portions 59*g*, to opposite anti-warping u-shaped vertical bars 56*a* and 56*b*, respectively.

Referring to FIGS. 4A, 4B, 4C, 4D, and 4E, each end of opposite anti-warping u-shaped vertical bars 56*a* and 56*b* is inserted, in the direction of arrow 60*c*, into one end of upper and lower anti-warping adjustable horizontal bars 60*a* and 60*b*, respectively (as illustrated in FIG. 2B), such that anti-warping u-shaped-bar gutters 57*a*, 57*b*, 58*a*, and 58*b* and anti-warping adjustable-horizontal-bar gutters 61*a* and 61*b* are aligned with one another, respectively.

Referring to FIG. 2A, chain-link-mesh tension rods 70*a* and 70*b* are inserted through opposite ends of the chain-link mesh 71, respectively.

Chain-link mesh 71 is tied to the upper and lower anti-warping adjustable horizontal bars 60*a* and 60*b*, by tie wires 63, respectively.

Chain-link-mesh tension rods 70*a* and 70*b* are hooked onto opposite welded tension hooks 59*a*, 59*b*, 59*c*, 59*d*, 59*e*, and 59*f*, respectively.

Referring to FIGS. 5A, 5B, 5C, 5D, and 5E, further, the adjustable gate comprises eight locking paddles 72*a*, 72*b*, 72*c*, 72*d*, 73*a*, 73*b*, 73*c*, and 73*d*. Locking paddles 72*a*, 72*b*, 72*c*, and 72*d* are molded to opposite self-locking paddle-nut 66*a*. Locking paddles 73*a*, 73*b*, 73*c*, and 73*d* are molded to opposite self-locking paddle-nut 66*b*.

Each of locking paddles 73*a*, 73*b*, 73*c*, and 73*d* has a locking tip 74.

Opposite self-locking paddle-nuts 66*a* and 66*b*. are screwed onto opposite truss eye-bolts 65*a* and 65*b*, respectively.

Opposite truss eye-bolts 65*a* and 65*b* are screwed into the opposite ends of turnbuckle 67, respectively.

Figure 6A:
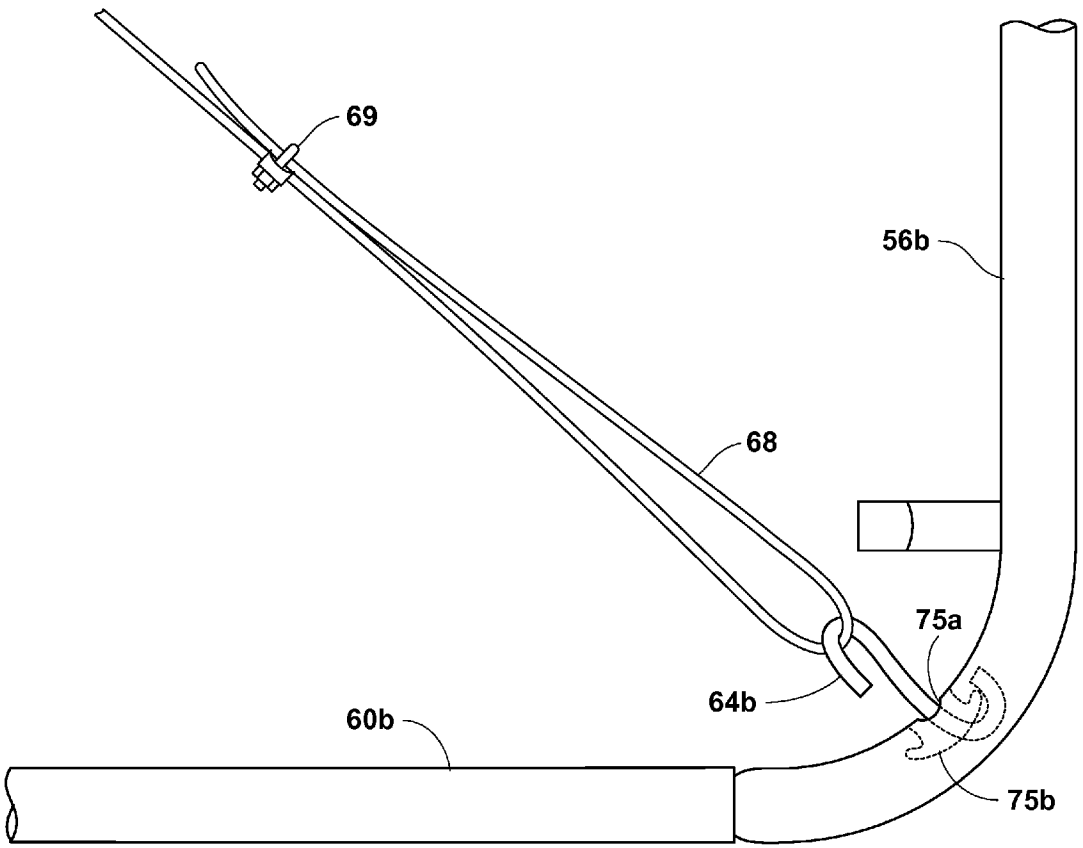
FIG. 6A illustrates a front view of a reinforced opening having an S-hook-interlocking circular hook.
Figure 6B:
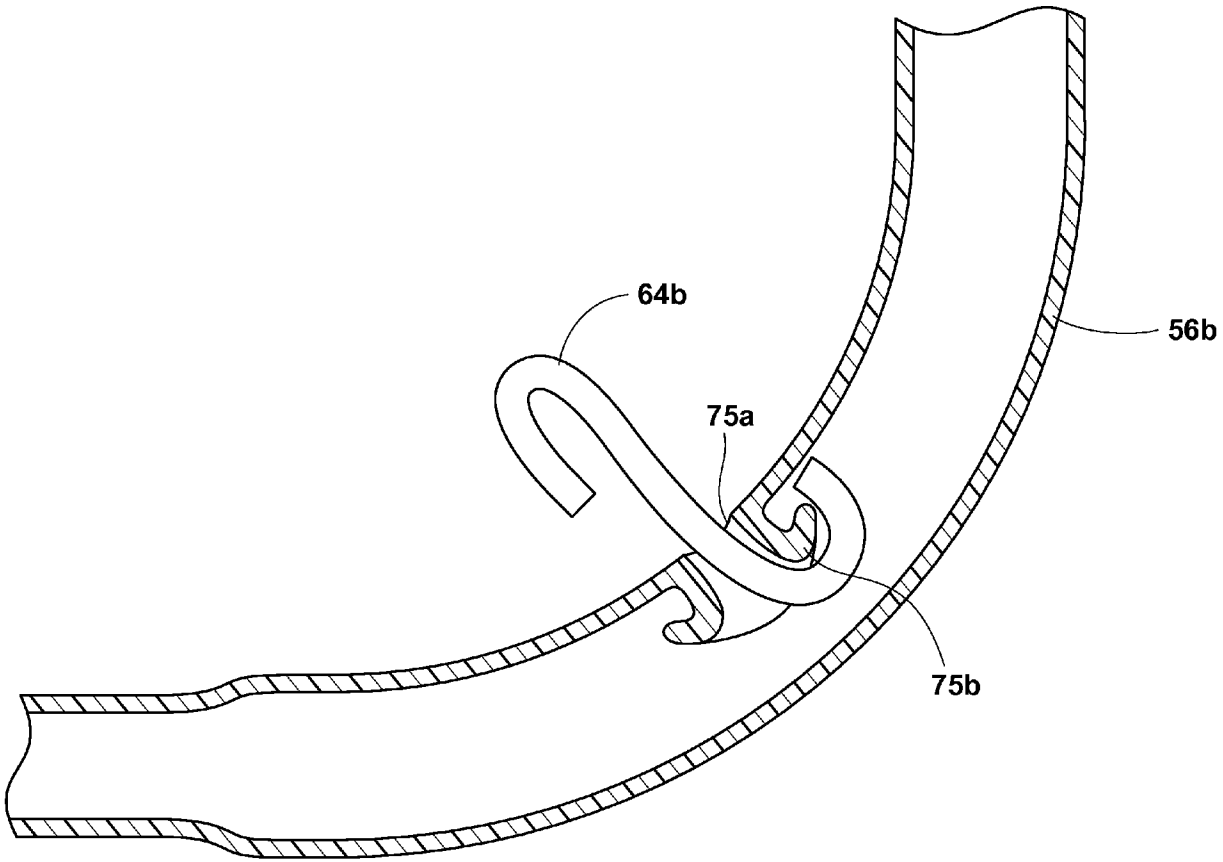
FIG. 6B illustrates a cross-sectional view of a reinforced opening having an S-hook-interlocking circular hook.

Referring to FIGS. 2A, 6A, and 6B, each end of truss wire 68 is secured by one of truss-wire clamps 69 creating two opposite loops thereof, respectively.

The two opposite loops are hooked onto one of opposite truss eye-bolts 65*a* and 65*b* and one of truss S-hooks 64*a* and 64*b*, respectively.

One of opposite truss eye-bolts 65*a* and 65*b* is hooked onto the other one of truss S-hooks 64*a* and 64*b*.

Each of opposite anti-warping u-shaped vertical bars 56*a* and 56*b* has a re-inforced opening 75*a* and an S-hook-interlocking circular hook 75*b*.

Truss S-hooks 64*a* and 64*b* are hooked into re-inforced openings 75*a* and onto S-hook-interlocking circular hooks 75*b*, respectively.

Four anti-warping u-shaped-bar gutters 57*a*, 57*b*, 58*a*, and 58*b* and two anti-warping adjustable-horizontal-bar gutters 61*a* and 61*b* are for aligning and preventing opposite anti-warping u-shaped vertical bars 56*a* and 56*b* and upper and lower anti-warping adjustable horizontal bars 60*a* and 60*b* from rotating, bending, and warping.

Two anti-warping adjustable-horizontal-bar gutters 61*a* and 61*b* are for the heads of self-tapping tapping screws 62 to be hidden therein, respectively, to eliminate personal injuries.

Upper and lower self-centering-screw guiding slots 61*c* and 61*d* are for centering and guiding self-tapping screws 62 through four anti-warping u-shaped-bar gutters 57*a*, 57*b*, 58*a*, and 58*b* and two anti-warping adjustable-horizontal-bar gutters 61*a* and 61*b*, respectively.

Upper and lower anti-warping adjustable horizontal bars 60*a* and 60*b* are for being cut to a desired length to adjust the width of the adjustable gate.

Self-tapping screws 62 are for being screwed through four anti-warping u-shaped-bar gutters 57*a*, 57*b*, 58*a*, and 58*b* and two anti-warping adjustable-horizontal-bar gutters 61*a* and 61*b* to secure them to one another.

Opposite welded tension hooks 59*a*, 59*b*, 59*c*, 59*d*, 59*e*, and 59*f* are for two chain-link-mesh tension rods 70*a* and 70*b* to be hooked thereon to tension chain-link mesh 71.

Opposite welded tension hooks 59*a*, 59*b*, 59*c*, 59*d*, 59*e*, and 59*f* are for being welded to the inner surfaces of opposite anti-warping u-shaped vertical bars 56*a* and 56*b*, respectively, to eliminate extraneous sections of opposite welded tension hooks 59*a*, 59*b*, 59*c*, 59*d*, 59*e*, and 59*f* and to eliminate personal injuries.

Two opposite self-locking paddle-nuts 66*a* and 66*b* are for securing and preventing turnbuckle 67 from unwinding.

Figure 5A:
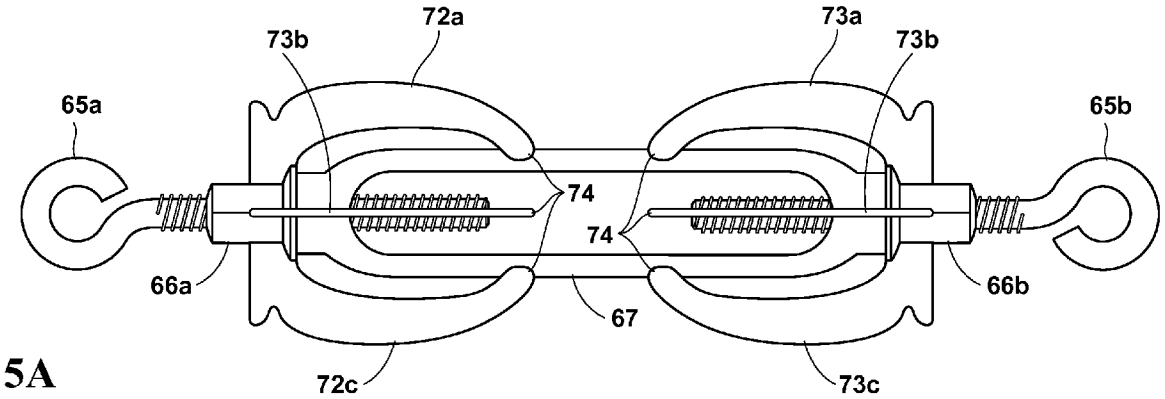
FIG. 5A illustrates a front view of a tension-adjusting turnbuckle having opposite self-locking paddle-nuts.
Figure 5B:
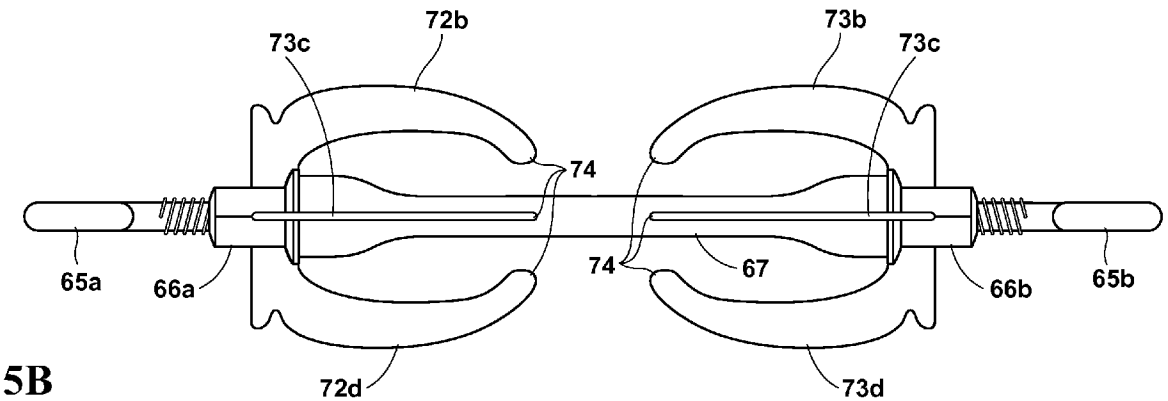
FIG. 5B illustrates a top view of a tension-adjusting turnbuckle having opposite self-locking paddle-nuts.
Figure 5C:
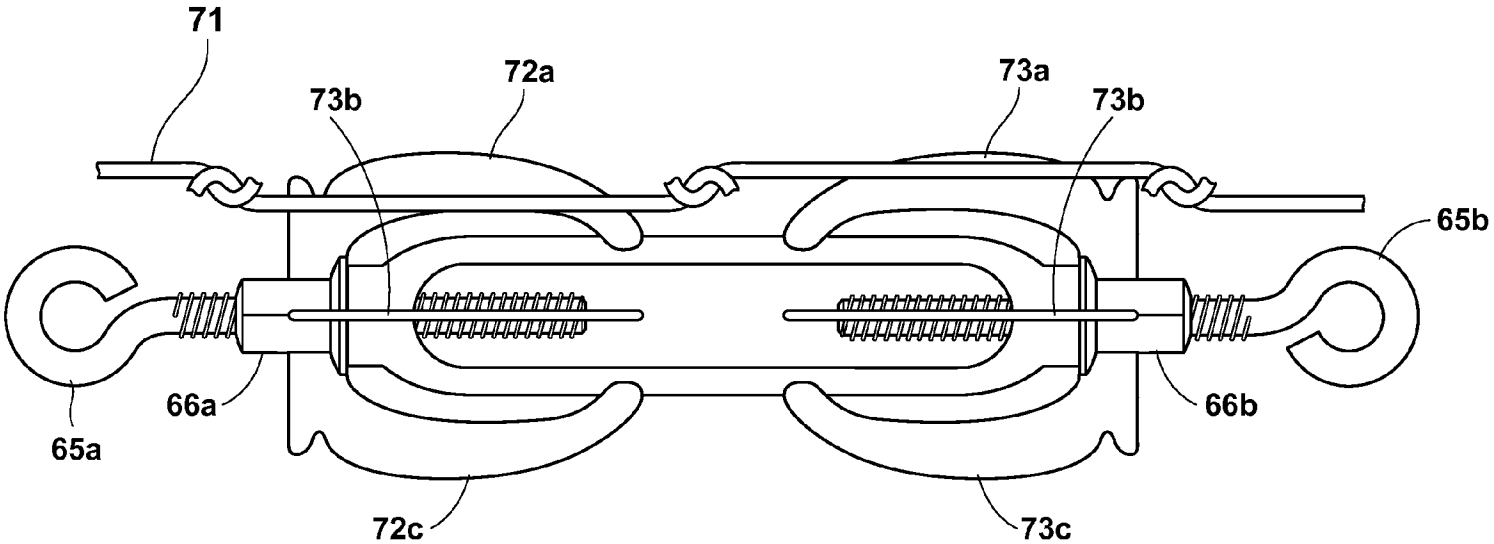
FIG. 5C illustrates a top view of a tension-adjusting turnbuckle having opposite self-locking paddle-nuts, in relation to a chain link of the adjustable gate.

Referring to FIGS. 5A, 5B, and 5C, each of eight locking paddles 72*a*, 72*b*, 72*c*, 72*d*, 73*a*, 73*b*, 73*c*, and 73*d* is for locking incrementally, via its respective locking tip 74, turnbuckle 67 each time turnbuckle 67 is rotated to tension truss wire 68.

S-hook-interlocking circular hooks 75*b* are for interlocking two truss S-hooks 64*a* and 64*b* when two truss S-hooks 64*a* and 64*b* are hooked thereon, respectively.

The material, used to make any component of the adjustable gate, can partially or entirely be rigid, non-rigid, flexible, non-flexible, pliable, non-pliable, elastic, non-elastic, resilient, non-resilient, etc. . . . , or a combination of at least two of the above.

For example, eight locking paddles 72*a*, 72*b*, 72*c*, 72*d*, 73*a*, 73*b*, 73*c*, and 73*d* can be made of flexible metal plates.

For example, truss wire 68 can be made of pliable steel wire.

For example, interlocking circular hooks 75*b* can be made of metal.

Operation

When a user opens or closes the adjustable gate or when there is a change in weather temperature, opposite anti-warping u-shaped vertical bars 56*a* and 56*b* and upper and lower anti-warping adjustable horizontal bars 60*a* and 60*b* will warp.

Four anti-warping u-shaped-bar gutters 57*a*, 57*b*, 58*a*, and 58*b* and two anti-warping adjustable-horizontal-bar gutters 61*a* and 61*b* will prevent opposite anti-warping u-shaped vertical bars 56*a* and 56*b* and upper and lower anti-warping adjustable horizontal bars 60*a* and 60*b* from warping.

Upper and lower self-centering-screw guiding slots 61*c* and 61*d* guide self-tapping screws 62 through four anti-warping u-shaped-bar gutters 57*a*, 57*b*, 58*a*, and 58*b* and two anti-warping adjustable-horizontal-bar gutters 61*a* and 61*b* when they are screwed therethrough, to secure the adjustable gate in its intended shape and size.

Four S-hook-interlocking circular hooks 75*b* interlock two truss S-hooks 64*a* and 64*b*, such that the higher tension truss wire 68 has, the more securely two truss S-hooks 64*a* and 64*b* interlock four S-hook-interlocking circular hooks 75*b*, to prevent four S-hook-interlocking circular hooks 75*b* from popping out of re-inforced opening 75*a*.

After rotating turnbuckle 67 to tighten truss wire 68 to a desired tension, eight locking paddles 72*a*, 72*b*, 72*c*, 72*d*, 73*a*, 73*b*, 73*c*, and 73*d* will incrementally secure turnbuckle 67, to maintain the desired tension of truss wire 68.

Ramifications

Opposite anti-warping u-shaped vertical bars 56*a* and 56*b* four anti-warping u-shaped-bar gutters 57*a*, 57*b*, 58*a*, and 58*b*, four S-hook-interlocking circular hooks 75*b*, opposite welded tension hooks 59*a*, 59*b*, 59*c*, 59*d*, 59*e*, and 59*f*, upper and lower anti-warping adjustable horizontal bars 60*a* and 60*b*, two anti-warping adjustable-horizontal-bar gutters 61*a* and 61*b*, upper and lower self-centering-screw guiding slots 61*c* and 61*d*, self-tapping screws 62, two opposite self-locking paddle-nuts 66*a* and 66*b*, and eight locking paddles 72*a*, 72*b*, 72*c*, 72*d*, 73*a*, 73*b*, 73*c*, and 73*d* can have a cross-section of any shape and size, for example, triangular, square, circular, oval, the like, the equivalent, etc.

Figure 5D:
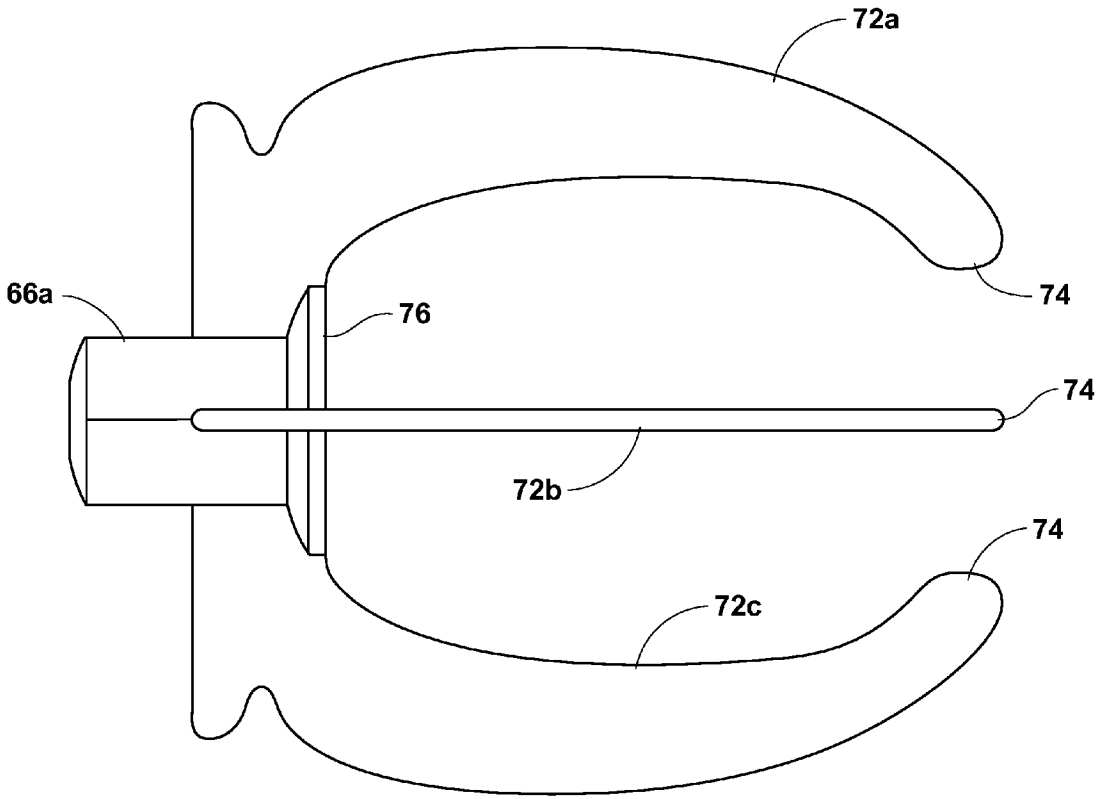
FIG. 5D illustrates a front view of one of the opposite self-locking paddle-nuts.
Figure 5E:
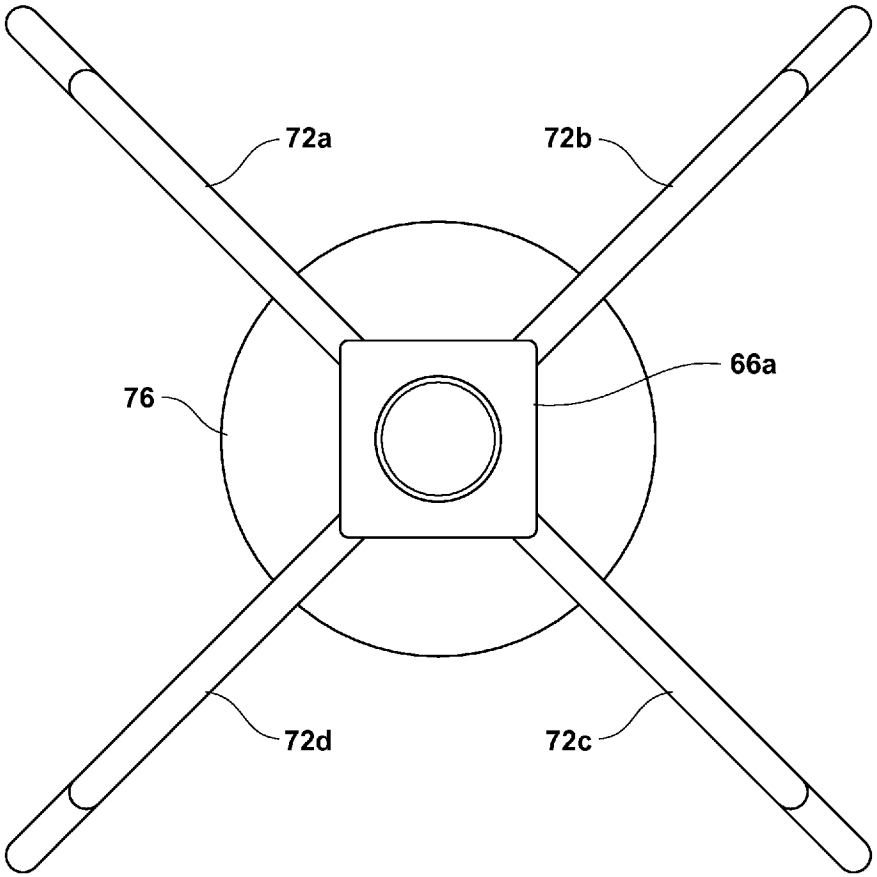
FIG. 5E illustrates a top view of one of the opposite self-locking paddle-nuts.

Each of two opposite self-locking paddle-nuts 66*a* and 66*b*, further, can comprise a washer 76 (see FIG. 5D).

Figure 7A:
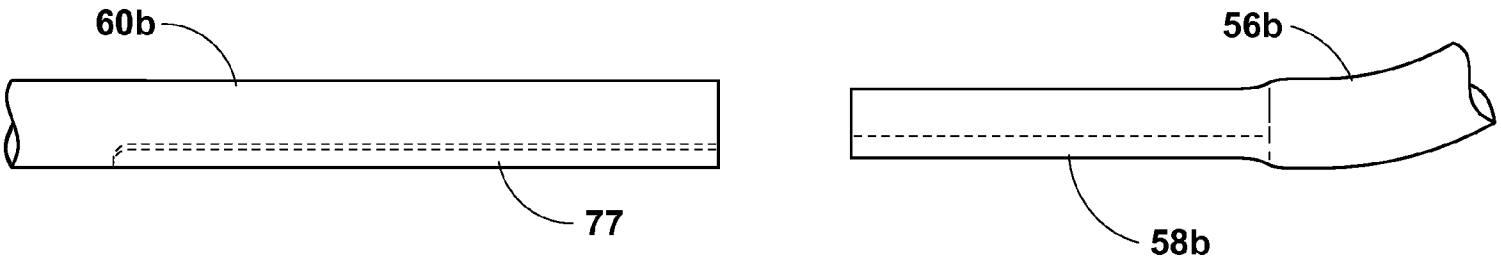
FIG. 7A illustrates a variation of the frame-anti-twisting and frame-stabilizing systems.

Each of four anti-warping u-shaped-bar gutters 57*a*, 57*b*, 58*a*, and 58*b* can have a pre-determined length 77 (see FIG. 7A).

Figure 7B:
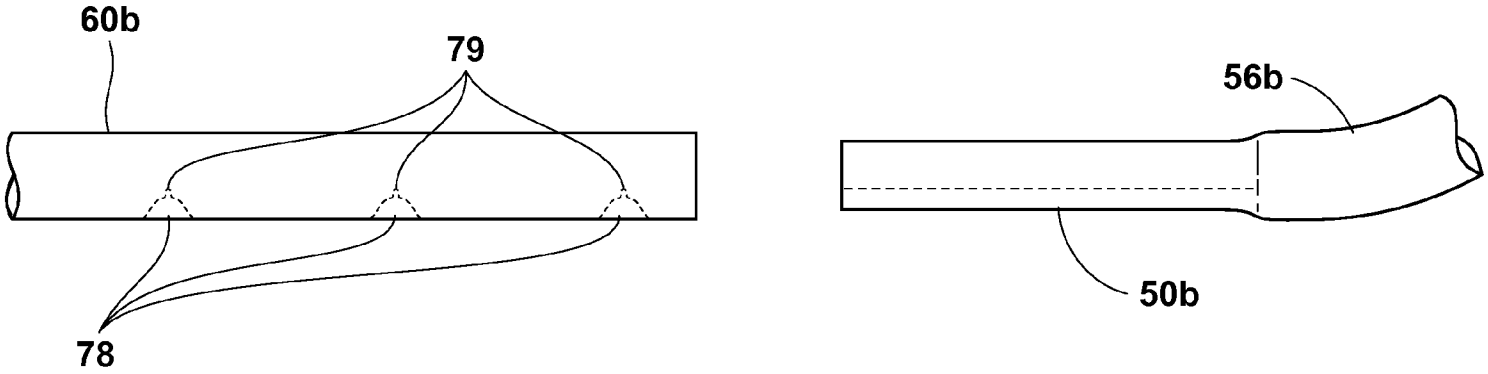
FIG. 7B illustrates another variation of the frame-anti-twisting and frame-stabilizing systems.

Each of two anti-warping adjustable-horizontal-bar gutters 61*a* and 61*b* can have a pre-determined length 78 (see FIG. 7B).

Each of four anti-warping u-shaped-bar gutters 57*a*, 57*b*, 58*a*, and 58*b* and two anti-warping adjustable-horizontal-bar gutters 61*a* and 61*b* can have a shape of a dimple 79 (see FIG. 7B). Each of dimples 79 functions as one of upper and lower self-centering-screw guiding slots 61*c* and 61*d*.

MAJOR ADVANTAGES OF THE INVENTION

The present invention substantially departs from the conventional concepts and designs of the prior art. In doing so, the present invention provides a unique adjustable gate having many unique and significant features, automatic functions, and advantages, which overcome all the disadvantages of the prior art, as follows:

1) It is an object of the present invention to provide the unique adjustable gate having opposite anti-warping systems, which have the anti-warping u-shaped-bar gutters of u-shaped vertical bars inserted into the anti-warping horizontal-bar gutters of horizontal bars to prevent the u-shaped vertical bars and the horizontal bars from rotating, bending, and warping in all horizontal directions. As a result, the opposite anti-warping systems prevent the adjustable gate from bending and warping in all horizontal directions.

2) It is another object of the present invention to provide the unique adjustable gate having opposite anti-warping systems, which have the anti-warping u-shaped-bar gutters of u-shaped vertical bars inserted into the anti-warping horizontal-bar gutters of horizontal bars to prevent the u-shaped vertical bars and the horizontal bars from rotating, bending, and warping. As a result, the opposite anti-warping systems eliminate the needs for an extra person to hold the horizontal bars and the u-shaped vertical bars still when screwing the screws through the horizontal bars and the u-shaped vertical bars to assemble the adjustable gate.

3) It is a further object of the present invention to provide the unique adjustable gate having opposite personal-injury-eliminating systems, which have the tension hooks welded to the u-shaped vertical bars to eliminate using tie wires to connect the u-shaped vertical bars to a chain-link mesh, to prevent the tie wires from cut and scratching people. As a result, the opposite personal-injury-eliminating systems eliminate personal injury.

4) It is an even further object of the present invention to provide the unique adjustable gate having opposite personal-injury-eliminating systems, which have the tension hooks welded to the u-shaped vertical bars to eliminate the needs for using many tie wires and an extra person to tediously and hazardously twist the tie wires to connect the u-shaped vertical bars to a chain-link mesh when assembling the adjustable gate. As a result, the opposite personal-injury-eliminating systems make the assembling of the adjustable gate easy, save time, and reduce hazard.

5) It is another object of the present invention to provide the unique adjustable gate having opposite screw-centering systems, which have the self-centering-screw guiding slots stamped into the anti-warping gutters of the horizontal bars to accurately guide a screw through the horizontal bars and the u-shaped vertical bars, to prevent accident. As a result, the opposite screw-centering systems eliminate accident and provide accuracy for the gate-assembling process.

6) It is yet another object of the present invention to provide the unique adjustable gate having opposite screw-centering systems, which have the self-centering-screw guiding slots stamped into the anti-warping gutters of the horizontal bars to accurately guide a screw through the horizontal bars and the u-shaped vertical bars, to prevent accident. As a result, the opposite screw-centering systems eliminate the needs for measuring, and speed up the process of the adjustable-gate assemblage.

7) It is still yet another object of the present invention to provide the unique adjustable gate having opposite S-hook-interlocking systems, which have the S-hook-interlocking circular hooks welded into the S-hook openings of the u-shaped vertical bars to reinforce the S-hook openings and to interlock the circular hooks and the S-hooks of a truss. As a result, the opposite S-hook-interlocking systems increase the strength the S-hook openings, durably interlock the S-hooks and the u-shaped vertical bars, and increase the durability and reliability of the gate-assemblage process.

8) It is still yet an even further object of the present invention to provide the unique adjustable gate having opposite turnbuckle-interlocking systems, which have the interlocking paddles molded into paddle-nuts to incrementally interlock with the turnbuckle of the truss in a predetermined position, to incrementally lock the truss wire at a predetermined tension. As a result, the opposite turnbuckle-interlocking systems incrementally and securely interlock the horizontal bars and the u-shaped vertical bars of the adjustable gate at a predetermined tension.

What is claimed is:

1. An adjustable gate, the adjustable gate comprising:

first and second u-shaped vertical bars, each of said vertical bars having two vertical-bar ends, a vertical-bar corner surface, and a vertical-bar opening disposed at said corner surface;

first and second I-shaped horizontal bars, each of said horizontal bars having two horizontal-bar ends, each of said horizontal-bar ends inserted into one of said vertical-bar ends to join said vertical bars and said horizontal bars together, respectively;

a chain-link mesh, said chain-link mesh having a top edge, a bottom edge, and two side edges;

a plurality of tie wires, said tie wires tying said top and bottom edges of said chain-link mesh to said first and second horizontal bars, respectively;

a turnbuckle, said turnbuckle having two opposite threaded ends;

first and second eye-bolts, each of said first and second eye-bolts having an elongated body and mating thread thereon, each of said first and second eye-bolts screwed into one of said threaded ends of said turnbuckle, respectively;

first and second S-hooks, said first S-hook having two first-S-hook ends, said second S-hook having two second-S-hook ends, one of said first-S-hook ends hooked into one of said vertical-bar openings, another of said first-S-hook ends hooked on said first eye-bolt;

a truss wire, said truss wire having two wire ends, one of said wire ends wrapped on said second eye-bolt, another of said wire ends wrapped on one of said second-S-hook ends, another of said second-S-hook ends hooked into another of said vertical-bar openings;

two wire clamps, each of said two wire clamps clamping on one of said two wire ends such that said two wire ends are hooked on said second S-hook and said second eye bolt, respectively;

an anti-warping system for preventing the adjustable gate from warping horizontally in all directions, said anti-warping system comprising four vertical-bar gutters and four horizontal-bar gutters mating to said four vertical-bar gutters, said four vertical-bar gutters stamped into said four vertical-bar ends and said four horizontal-bar gutters stamped into said four horizontal-bar ends, respectively, to prevent said vertical and horizontal bars from twisting and warping when said four horizontal-bar ends are inserted into said four vertical-bar ends, respectively;

a personal-injury-eliminating system comprising first and second tension rods and a plurality of tension hooks, each of said first and second tension rods inserted through one of said two side edges of said chain-link mesh, said tension hooks welded to said first and second vertical bars respectively, said first and second tension rods hooked on said tension hooks respectively, to eliminate personal injury caused by said tie wires;

a screw-centering system comprising a plurality of screws and a plurality of guiding slots, said guiding slots stamped into said vertical-bar gutters at predetermined locations therein for said screws to be inserted therein and screwed through said vertical-bar and horizontal-bar gutters, respectively;

an S-hook-interlocking system for interlocking said two S-hooks with said two vertical-bar openings, said S-hook-interlocking system comprising two circular hooks, said two circular hooks welded to and surrounding said two vertical-bar openings for reinforcing said two vertical-bar openings and for said two S-hooks to be hooked thereon to interlock with said two S-hooks; and a turnbuckle-interlocking system for incrementally securing the tension of said truss wire, said turnbuckle-interlocking system comprising two nuts, each of said nuts being screwed onto a respective one of said first and second eye bolts at outer ends of said turnbuckle, and each nut having a plurality of pairs of diametrically opposed, radially flexible interlocking paddles extending longitudinally towards said turnbuckle and radially inwardly biased to engage with said turnbuckle, such that when said turnbuckle is rotated between adjacent pairs of said interlocking paddles, said paddles interlock with said turnbuckle and allow the tension of said truss wire to be adjusted and secured incrementally.

2. The adjustable gate of claim 1, wherein each of said interlocking paddles has a Letter-C shape.

3. The adjustable gate of claim 1, wherein said screws are tapping screws.

4. The adjustable gate of claim 1, further comprising a first post and a plurality of hinge assemblies, said hinge assemblies for pivotably connecting said first post to the adjustable gate.

5. The adjustable gate of claim 1, further comprising a second post and a latch assembly, said latch assembly for being attached to the adjustable gate and for latching the adjustable gate to said second post.

6. The adjustable gate of claim 1, wherein said vertical bars are made of stainless steel.

7. The adjustable gate, of claim 1, wherein said horizontal bars are made of stainless steel.

8. The adjustable gate, of claim 1, wherein the cross-section of each of said vertical-bar and horizontal-bar gutters has a V shape or U shape.

9. The adjustable gate of claim 1, wherein each of said two circular hooks has an outer circular edge, wherein said outer circular edge is bent.

* * * * *